United States Patent [19]

Gatlin

[11] Patent Number: 4,709,925

[45] Date of Patent: Dec. 1, 1987

[54] TACTILE TRAINING DEVICE FOR A TENNIS RACKET HANDLE

[76] Inventor: C. Elmon Gatlin, 620 E. Twiggs, Tampa, Fla. 33602

[21] Appl. No.: 823,128

[22] Filed: Jan. 27, 1986

Related U.S. Application Data

[63] Continuation of Ser. No. 682,803, Dec. 17, 1984, abandoned, which is a continuation of Ser. No. 431,797, Sep. 30, 1982, abandoned.

[51] Int. Cl.[4] ..... A63B 69/38

[52] U.S. Cl. ..... 273/29 A; 273/75

[58] Field of Search ..... 273/26 R, 29 A, 81 D, 273/82, 72, 67, 81.2, 16.5

[56] References Cited

U.S. PATENT DOCUMENTS

| | | | |
|---|---|---|---|
| 174,490 | 2/1922 | Walker | 273/165 |
| 1,569,340 | 1/1926 | Vaile | 273/165 |
| 3,203,697 | 8/1965 | Berzatzy | 273/81 D |
| 3,533,630 | 10/1970 | Monaco | 273/81.2 |
| 3,880,443 | 4/1975 | Tobin | 273/81 D |
| 4,052,059 | 10/1977 | Rigsby | 273/165 |
| 4,252,317 | 2/1981 | Vezina | 273/81.2 |

FOREIGN PATENT DOCUMENTS

| | | | |
|---|---|---|---|
| 239706 | 9/1925 | United Kingdom | 273/165 |

*Primary Examiner*—Richard C. Pinkham
*Assistant Examiner*—T. Brown
*Attorney, Agent, or Firm*—Dominik, Stein, Saccocio & Reese

[57] ABSTRACT

An attachment to the handle of a racket which tactically indicates to a player whether his/her hand has properly gripped the handle of a racket for forehand and backhand play. The attachment is an elongated member non-rotatably connected to the butt of the handle and positioned substantially parallel to the face of the racket such that it bears evenly against the heel of a player's hand when he/she properly grips the handle. The elongated member further includes a contoured recess configured to comfortably receive the outer edge of a player's hand when the hand has been rotated substantially ninety degrees from the forehand to the backhand play positions.

9 Claims, 5 Drawing Figures

TACTILE TRAINING DEVICE FOR A TENNIS RACKET HANDLE

This is a continuation of co-pending application Ser. No. 682,803, (now abandoned), filed on Dec. 17, 1984, which is a continuation of Ser. No. 431,797, filed on Sept. 30, 1982 (now abandoned).

BACKGROUND OF THE INVENTION

1. Field of the Invention

This invention relates to training devices designed to be connected to rackets such as tennis rackets to assure that the tennis player has properly gripped the handle thereof for forehanded and backhanded strokes of the racket. More particularly, this invention relates to a tactile tennis trainer which provides a tactual indication to the tennis player when the handle of the tennis racket is properly gripped and oriented for forehanded and backhanded play.

2. Description of the Prior Art

The game of tennis has proliferated within the past decade throughout the world and has become a game that is enjoyed by tennis players of all ages. Unfortunately, one major factor which precludes more people from becoming involved with the game is the fact that a fair degree of skill must be acquired in order for the game to become enjoyable. This is because the beginning tennis player, not having the skill necessary to return volleys, will spend the majority of the time chasing balls rather than engaged in enjoyable volley. Many potential tennis players, therefore, give up the game before they become sufficiently proficient.

Presently, there exist many training aids designed to increase the speed with which the novice player learns the game of tennis. Basically, these aids include some sort of grip which is attached to the handle of the tennis racket, the grip including contours for the hand of the tennis player or, more specifically, the index finger of the tennis player. Unfortunately, many of these devices are incapable of adequately or promptly providing an indication to the tennis player as to whether the handle of the tennis racket is properly oriented for forehanded and backhanded strokes of the tennis racket.

Therefore it is an object of this invention to provide an apparatus which overcomes the aforementioned inadequacies of the prior art devices and provides an improvement which is a significant contribution to the training device art.

Another object of this invention is to provide a training device which eliminates the need for visually inspecting whether the player has properly gripped the handle of the racket for forehanded and backhanded play.

Another object of this invention is to provide a tennis racket trainer which provides a tactual indication to the tennis player as to whether the handle of the tennis racket is properly gripped for forehanded strokes and backhanded strokes.

Another object of this invention is to provide a tennis trainer which may be incorporated in the grip of the tennis racket.

Another object of this invention is to provide a tennis trainer which may be retrofitted to existing tennis rackets and then removed therefrom after the tennis player has become sufficiently proficient at the game and therefore no longer needs the assistance of the tennis trainer.

Another object of this invention is to provide a tennis trainer which is economically manufactured and is sufficiently durable to withstand the rigors of the game of tennis.

Another object of this invention is to provide a tennis trainer which does not interfere with the stroking of the tennis racket during normal play.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a tactile tennis trainer which is operatively connected to the butt of the handle of a racket such as a tennis racket. The tactile tennis trainer functions to provide a two position tactual indication to the tennis player as to whether the tennis player has properly gripped the handle of the tennis racket for forehanded and backhanded play. More particularly, the tennis trainer of the invention comprises an elongated body member which is operatively connected to the butt of the handle in a position parallel to the face of the racket. One end of the body member which extends transversely from the butt of the handle includes a contoured recess to receive the outer edge of the palm of the tennis player's hand.

During use for forehanded play, the face of the tennis racket is oriented vertically and then the handle is grasped by the tennis player in a manner similar to which the player would shake hands with another person. In this position, the elongated body member of the tennis trainer is positioned parallel to the heel of the hand and the wrist of the tennis player. Should the tennis racket become improperly oriented (twisted) during the play of the game, the training device will tactually indicate to the tennis player that such a disorientation has occurred. For backhanded play, the tennis player rotates the tennis racket 90 degrees toward the right or left direction, depending on whether the tennis player is right-handed or left-handed. In this position, the edge of the tennis player's hand is comfortably seated within the contoured recess of the end of the elongated body member. Similar to forehanded play, any disorientation of the tennis racket during backhanded play will be tactually indicated to the tennis player due to the fact that the edge of the hand of the tennis player will not then be comfortably seated within the contoured recess.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
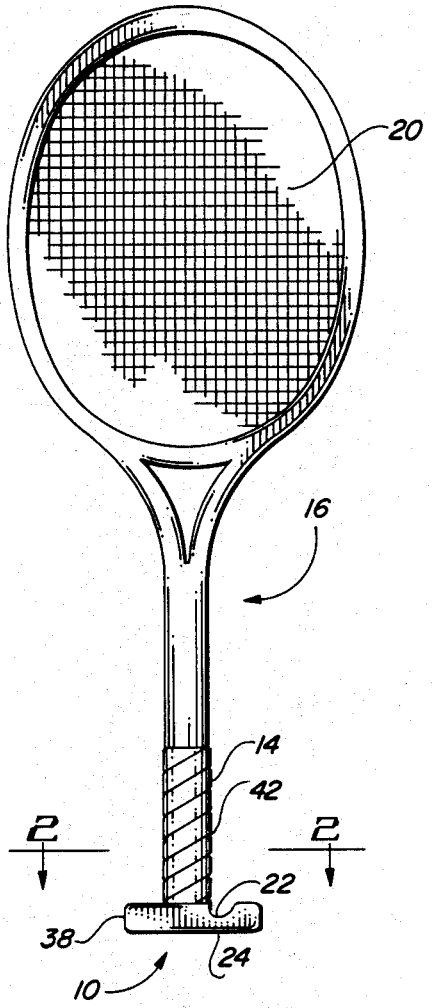
FIG. 1 is a plan view illustrating the tennis trainer of the invention installed on the butt of a conventional tennis racket.

FIG. 1 is a plan view of the tennis trainer 10 of the invention installed on the butt 12 of the handle 14 of a conventional racket such as a tennis racket 16. Basically, the tennis trainer 10 comprises an elongated member 18 which is affixed to the butt 12 of the handle 14 in a position parallel to the face 20 of the racket 16. A contoured recess 22 is incorporated within one end 24 of the elongated member 18. The recess 22 is specifically contoured to receive the outer edge of a person's hand; specifically, the abductor digitalis V muscle of the human hand.

Figure 2:
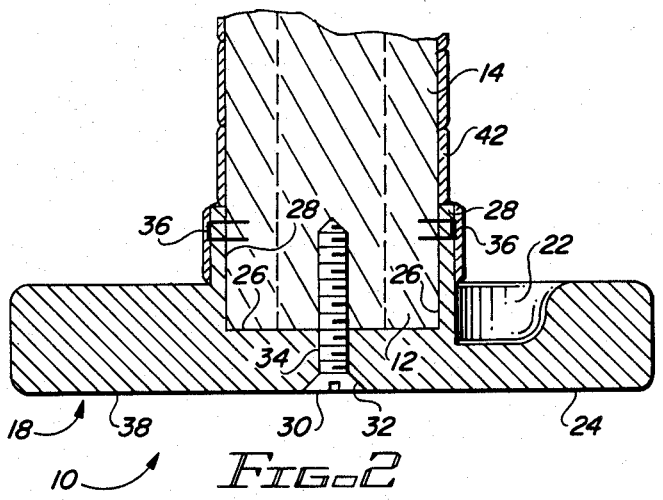
FIG. 2 is a cross sectional view of FIG. 1. along lines 2—2 illustrating the contoured recess for receiving the outer edge of the hand of the tennis player.
Figure 3:
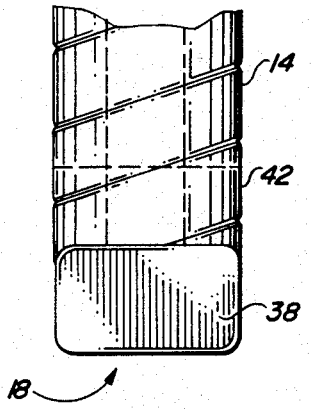
FIG. 3 is an end view of FIG. 1.

As illustrated in FIGS. 2 and 3, the preferred embodiment of the tennis trainer 10 comprise an integral unit which is formed by conventional injection molding techniques. More particularly, the elongated member 18 of the preferred embodiment of the tennis trainer 10 includes an integral octagonal-shaped cavity 26 which is dimensioned to receive the butt 12 of the handle 14 of the tennis racket 16, the butt cap and leather grip of the handle 14 having been removed. The elongated member 18 may further include an integral octagonal-shaped sleeve 28 which is aligned with the cavity 26. The sleeve 28 functions to provide further rigidity to the trainer 10 when the trainer is affixed to the butt 12 of the handle 14.

The elongated member 18 may be affixed to the butt 12 of the handle 14 by means of an adhesive (not shown), by means of a threaded fastener 30 which extends through a counterbore 32 and a hole 34 in the bottom of the elongated member 18 for threaded engagement with the butt 12 of the handle 14, and/or by means of a plurality of staples 36 which are forced through the sleeve 28 into the handle 14 of the racket 16. After the preferred embodiment of the tennis trainer 10 is affixed to the butt 12 of the handle 14, the sleeve 28 and the handle 14 of the racket 16 are wrapped with a leather grip 42 in the conventional manner.

Preferably, the elongated member 18 of the tennis trainer 10 is configuration such that the other end 38 extends orthogonally from the handle 18 a distance approximately equal to the length of the first end 24, and such that the elongated member 18 is centered with respect to the butt 12 of the handle 14. Also preferably, the overall length of the elongated member 18 is approximately equal to the width of the inner wrist of a human hand (3–4 inches) such that sufficient length is provided in the first end 24 for the contoured recess 22 and such that the elongated member 18 is sufficiently long to provide a tactual indication to the tennis player as to whether the elongated member 18 is parallel to the heel of his hand. This assures that when the handle 14 of the tennis racket 16 is gripped for forehanded play, the tennis player will be able to tactually know whether he has properly gripped the handle 14. Additionally, should the handle 14 become twisted during play, one of the ends 24 or 38 will bear against the inner wrist or the heel of hand of the tennis player thereby tactually indicating to the player that the tennis racket 18 has become twisted and needs to be re-grasped in correct alignment for forehanded play.

As noted earlier, the contoured recess 22 of the tennis trainer 10 is configured to comfortably receive the outer edge of the tennis player's hand only when the handle 18 is twisted 90 degrees (the proper backhanded grip position). During play, should the racket 16 become twisted from its proper 90 degree position, the player's hand will no longer be comfortably seated in the recess 22, thereby indicating to the player that the racket 16 has become twisted and should be re-aligned to its correct 90 degree position.

Because of the symmetry of the tennis trainer, it should be appreciated that the preferred embodiment of the tennis trainer 10 functions to provide two positions, a forehanded and a backhanded position, which tactually indicate to the player whether he has correctly gripped the handle 14 of the tennis racket 16 for forehanded and backhanded play, respectively. It should also be appreciated that the preferred embodiment of the tennis trainer 10 may be utilized by both left-handed and right-handed tennis players.

Figure 4:
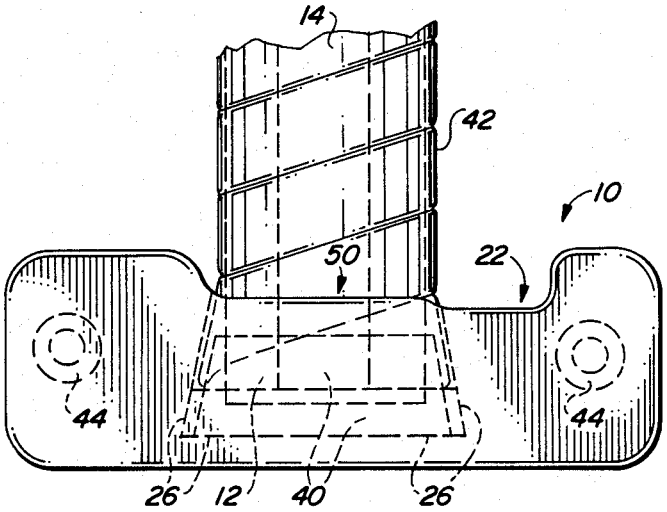
FIG. 4 is a plan view of the second embodiment of the tennis trainer which comprises two halves of an elongated member which is fitted about the butt of the handle of the tennis racket.
Figure 5:
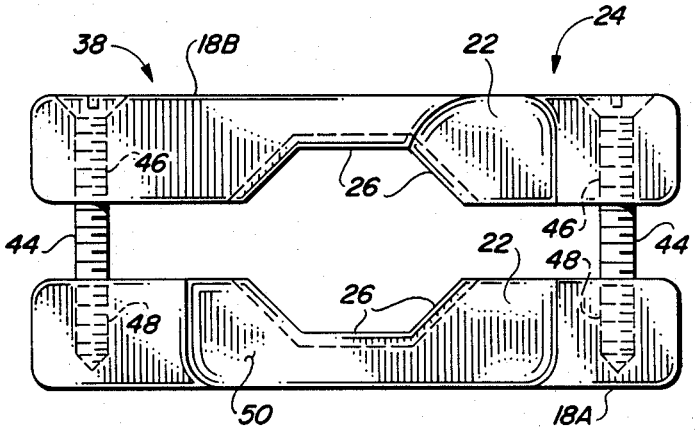
FIG. 5 is a view along the longitudinal axis of the racket handle in FIG. 4.

FIGS. 4 and 5 illustrate the second embodiment of the tennis trainer 10 which is designed to be easily removeable from the butt 12 of the handle 14 of a conventional racket 16. More specifically, the elongated member 18 of the second embodiment of the tennis trainer 10 is longitudinally divided into two halves 18A and 18B. The cavity 26 formed within each half 18A and 18B of the elongated member 18 includes an octagonally flared configuration dimensioned to fit about the end cap 40 and the leather grip 42 of the handle 14. The halves 18A and 18B are rigidly secured together about the end cap 40 and leather grip 42 by means of a pair of threaded fasteners 44 which engage through hole 46 in one of the halves of the elongated member 18 for threaded engagement with a corresponding threaded hole 48 in the other half of the elongated member 18.

The contoured recess 22 is positioned transversely through each half 18A and 18B of the elongated member 18 to comfortably receive the outer edge of the tennis player's hand. Since the second embodiment of the tennis trainer 10 will be clamped about the end cap 40, it is noted that the effective length of the handle 14 will be appreciably decreased. Accordingly, the second embodiment of the tennis trainer 10 may include a second recess 50 positioned longitudinally along one of the halves 18A of the elongated member 18 such that the outer edge of the player's hand is seated therein when the player has grasped the racket 16 for forehanded play. Of course, the racket 16 may be quickly rotated 90 degrees to the backhanded position where the outer edge of the tennis player's hand will be comfortably seated within recess 22.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A training device for tactually indicating to a player whether the player's hand has properly gripped the handle of a racket for forehanded play and for backhanded play, with the proper forehanded play position being defined as gripping the handle such that the racket face is substantially parallel to the heel of the player's hand and with the proper backhanded play being defined as gripping the handle ninety degrees from the proper forehanded play position, comprising in combination:

an elongated member;

means for connecting said elongated member relative to the butt of the racket in a non-rotatable position substantially parallel to the face of the racket such that said elongated member bears evenly against the heel of the player's had when the player has properly gripped the racket in the forehanded position, thereby tactually indicating to the player whether the racket is properly oriented for forehanded play; and said elongated member including a contoured recess configured to comfortably receive the outer edge of the player's hand when the player's hand has been rotated substantially ninety degrees from the forehanded play position to the backhanded play position with the elongated member unchanged in its location relative to the handle thereby tactually indicating to the player whether the racket is properly oriented for backhanded play.

2. The training device as set forth in claim 1, wherein said elongated member is affixed to the butt of the racket at the mid-portion of said elongated member.

3. The training device as set forth in claim 2, wherein said connecting means comprises incorporating a cavity in said elongated member for receiving the butt of the racket.

4. The training device as set forth in claim 3, further including a fastener for fastening said elongated member to the butt of the racket.

5. The training device as set forth in claim 2, wherein said connecting means comprises a sleeve connected to said elongated member for receiving the butt of the tennis racket.

6. The training device as set forth in claim 5, wherein said sleeve is affixed to the butt of the racket.

7. The training device as set forth in claim 1, wherein said elongated member comprises two half sections for connection about the handle of the racket.

8. The training device as set forth in claim 7, wherein said connecting means comprises means for rigidly affixing said halves of said elongated member about the handle of the racket.

9. A training device for tactually indicating whether the handle of a racket has been properly gripped for forehanded play, comprising in combination:

an elongated member;

means for connecting said elongated member relative to the butt of the racket in a position substantially parallel to the face of the racket, whereby said elongated member tactually indicates to the player utilizing the racket whether the racket is properly oriented for forehand play;

said elongated member further comprising a contoured recess for comfortably receiving the outer edge of a human hand whereby said recess of said elongated member tactually indicates to the player whether the racket is correctly oriented for backhanded play;

said elongated member comprising two half sections for connection about the handle of the racket;

said connecting means comprising means for rigidly affixing said halves of said elongated member about the handle of the racket; and said affixing means comprising a pair of threaded fasteners which threadedly secure one half of said elongated member with the other half of the said elongated member.

* * * * *